US006288681B1

(12) United States Patent
Kim et al.

(10) Patent No.: US 6,288,681 B1
(45) Date of Patent: Sep. 11, 2001

(54) DUAL-BAND ANTENNA FOR MOBILE TELECOMMUNICATION UNITS

(75) Inventors: Jong Kyu Kim; In Shig Park; Ho Seok Seo, all of Kyunggi-Do (KR)

(73) Assignee: Korean Electronics Technology Institute, Kyunggi-Do (KR)

( * ) Notice: Subject to any disclaimer, the term of this patent is extended or adjusted under 35 U.S.C. 154(b) by 0 days.

(21) Appl. No.: 09/401,469

(22) Filed: Sep. 22, 1999

(30) Foreign Application Priority Data

Sep. 25, 1998 (KR) ..... 98-39926

(51) Int. Cl.[7] ..... H01Q 1/24
(52) U.S. Cl. ..... 343/702; 343/895
(58) Field of Search ..... 343/895, 702

(56) References Cited

U.S. PATENT DOCUMENTS 4,442,438 * 4/1984 Siwiak et al. ..... 343/792
5,708,448 * 1/1998 Wallace ..... 343/895
5,861,859 * 1/1999 Kanayama ..... 343/895
5,990,848 * 11/1999 Annamaa et al. ..... 343/895
6,018,321 * 1/2000 Simmons et al. ..... 343/702
6,023,251 * 2/2000 Koo et al. ..... 343/895
6,031,493 * 2/2000 Tsuda et al. ..... 343/702
6,054,966 * 4/2000 Haapala ..... 343/895
6,075,488 * 6/2000 Hope ..... 343/702

* cited by examiner

*Primary Examiner*—Don Wong
*Assistant Examiner*—Tuyet T. Vo
(74) *Attorney, Agent, or Firm*—Rosenman & Colin, LLP

(57) ABSTRACT

A dual-band antenna for mobile communication unit is provided with a support made of insulating materials, a first and a second helical conductors, and a coaxial feeder connected to an end of each of the helical conductors. The first and the second helical conductors are wound on the support to be separated from each other and have a different resonance frequency, respectively. When a voltage is applied to the first and the second helical conductors through the coaxial feeder, the antenna operates in the optimum performance at two frequency bands. As a result, the unit can use a desired different mobile telecommunication service without changing it. Further, the inventive antenna is designed to be small in size to thereby allow it to be adapted on the mobile telecommunication unit.

3 Claims, 11 Drawing Sheets f=850MHz f=1.8GHz

DUAL-BAND ANTENNA FOR MOBILE TELECOMMUNICATION UNITS

FIELD OF THE INVENTION

The present invention relates to an antenna for transmitting and receiving radio frequency signals; and, more particularly, to a dual-band antenna for mobile telecommunication units, capable of operating in two frequency bands.

DESCRIPTION OF THE PRIOR ART

Nowadays, a variety of mobile telecommunication services are being or in the process of being commercially offered in all over the world. While some of these mobile telecommunication services utilize the same frequency band by employing a separate modulating system, majority of these mobile telecommunication services in general utilize different frequency bands from each other as exemplified by the cellular system and the personal communication system (PCS), the cellular system and the PCS system utilizing a frequency band of 824 to 894 MHz and 1.75 to 1.87 GHz, respectively.

A retractable antenna, in which a monopole antenna and a helical antenna are joined to each other and which is contractibly mounted on an upper portion of a mobile phone unit, is most widely used.

When the retractable antenna is extended out from the mobile unit, the monopole antenna operates independently or together with the helical antenna to transmit and receive a signal of a desired frequency band. When it is contracted in the mobile unit, only the helical antenna operates.

This retractable antenna, while suitable for operating only in one frequency band, is unsuitable for use in two or more different mobile telecommunication services, each telecommunication service operating in a different frequency band, while maintaining a desired radiation pattern. The reasons are as follows: Firstly, in order to make it possible for the antenna to operate at the frequency bands of both of the cellular system and the PCS, a complex matching circuit must be realized, matching a part or all of the bands, since a bandwidth between the cellular system and the PCS is in the neighborhood of 1 GHz; secondly, it is difficult to use one antenna for two different frequency bands since the central frequency of one mobile telecommunication frequency band is not a multiple of the harmonic component of that of the other mobile telecommunication frequency band; and thirdly, even if the antenna has been matched for use in two or more frequency bands, it is often difficult to realize a desired radiation pattern with the antenna at each of the frequency bands. In other words, in order to be serviced by a mobile telecommunication service, it is desirable for the customer to have a mobile phone unit designed for that particular frequency band thereof.

Therefore, in order to alleviate such a problem, a mobile phone unit, and hence, the parts therefor, capable of being used in mobile telecommunication services operating at different frequency bands, is desired.

There is shown in FIG. 1 a conventional dual-band helical antenna which operates in two frequency bands. As shown, the dual-band helical antenna includes a support 120 made of insulating materials and coils 130 and 140 wound on an upper port 100 and a lower part 110 of the support 120, respectively, thereby forming two helical antennas. The helical antennas are designed to have different resonance frequencies, respectively. Further, an inner portion of the support 120 is provided with a coaxial line. At this time, a winding number and a length of each of the coils wound on two helical antenna and a distance between the coils thereon, etc, are different for one another in such a way that each of the helical antennas is provided with a different resonance frequency.

Therefore, when a voltage is applied through a coaxial line in the support 120, two helical antennas resonate at two different frequency bands, respectively.

However, the above described antenna has a shortcoming in that since the helical antenna is divided into the upper part and the lower part of the support, it is rather bulky and hence occupies a large space in the mobile phone unit, thereby posing an obstacle to current trend in mobile phone design of downsizing, i.e., to make the phone as light and as small as possible.

SUMMARY OF THE INVENTION

It is, therefore, a primary object of the invention to provide a dual-band antenna for mobile telecommunication units capable of operating in two frequency bands.

Another object of the present invention is to provide a dual-band antenna for mobile communication units which is small in size.

In accordance with one aspect of the present invention, there is provided a dual-band antenna for mobile communication units comprising a support made of insulating materials; a first helical conductor wound on the support and having a first resonance frequency; a second helical conductor wound on the support and having a second resonance frequency, the second helical conductor being separated from the first helical conductor; and a coaxial feeder connected to an end of each of the helical conductors and for applying a voltage thereto.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
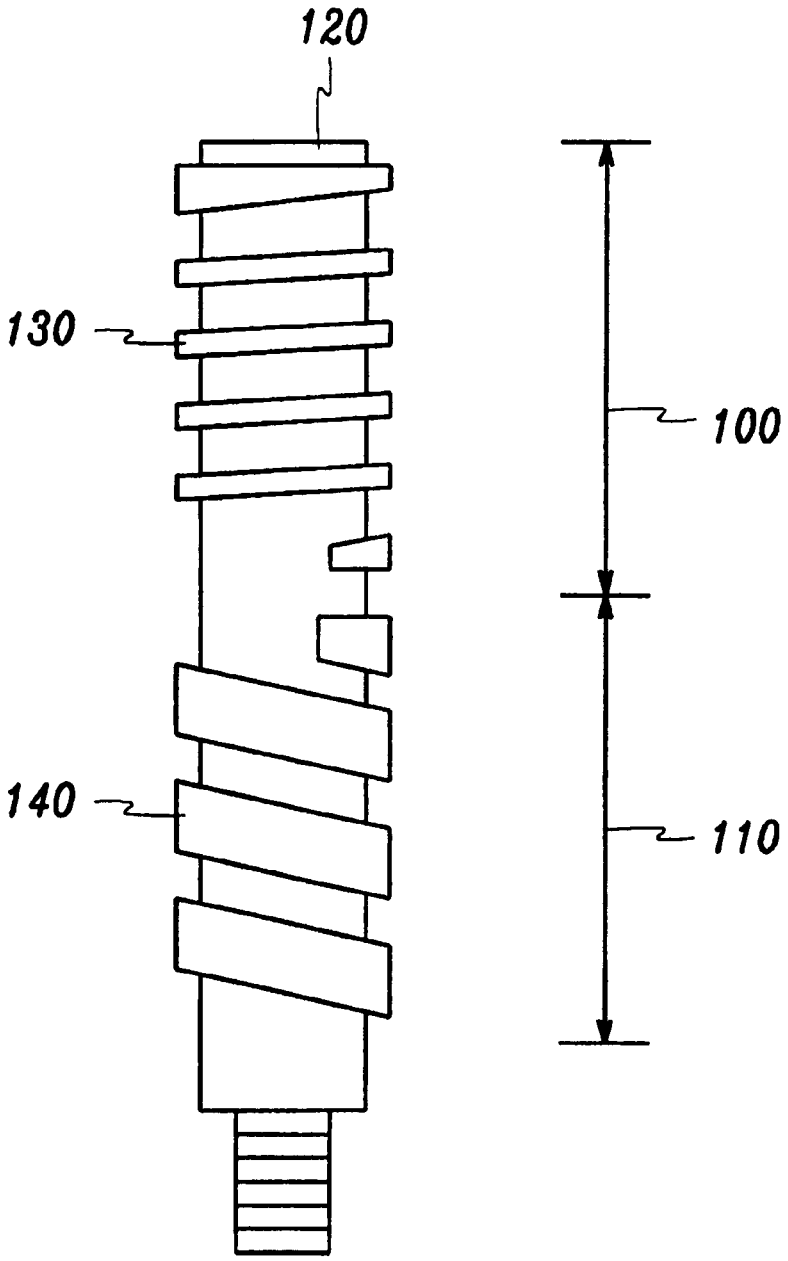
FIG. 1 (PRIOR ART)
FIG. 1 represents a cross sectional view of a conventional dual-band antenna.
Figure 2A:
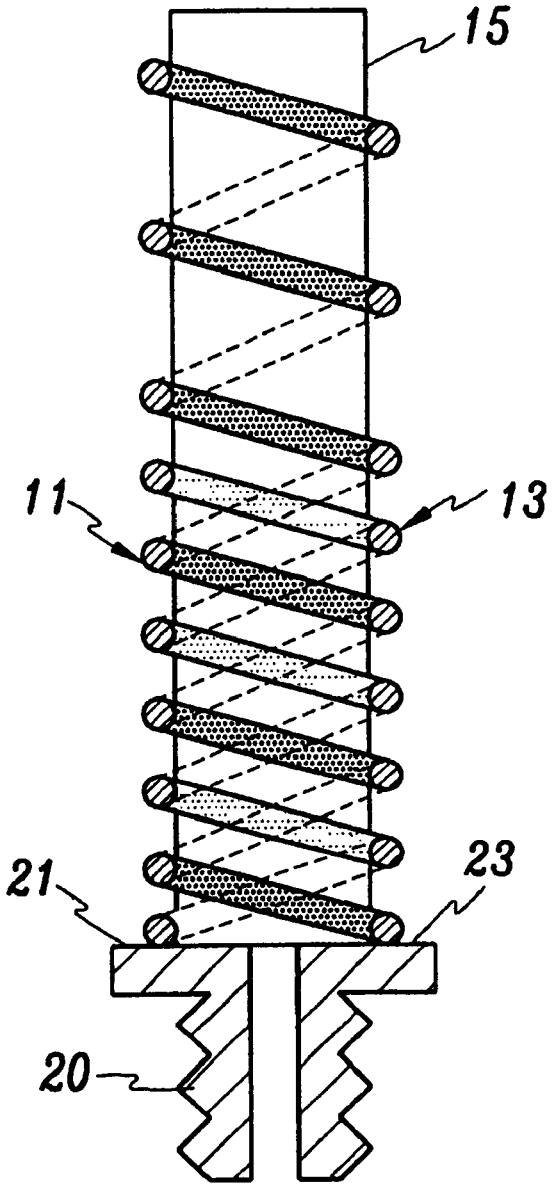
FIGS. 2A and 2B depict cross sectional views of a dual-band antenna for mobile telecommunication units in accordance with a first embodiment of the present invention.
Figure 2B:
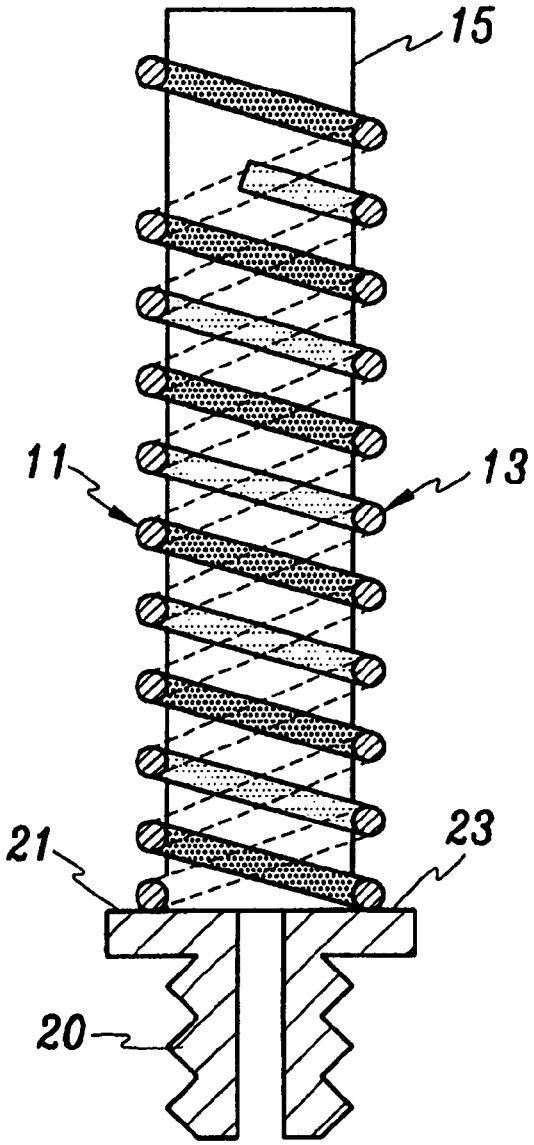

There is shown in FIGS. 2A and 2B a dual-band antenna for mobile telecommunication units of the present invention.

As shown, the inventive dual-band antenna includes a support 15 made of insulating materials, a first and a second helical conductors 11 and 13, and a coaxial feeder 20.

The first and the second helical conductors 11 and 13 are wound on the support 15 and have a first resonance frequency and a second resonance frequency, respectively. The helical conductors 11 and 13 are separated from each other.

The coaxial feeder 20 is connected to an end of each of the helical conductors 11 and 13 for applying a voltage thereto. Further, the other end of the first helical conductor 11 is connected to a first feeder distribution center 21, while the other end of the second helical conductor 13 is connected to a second feeder distribution center 23.

The respective lengths and the respective winding numbers of the helical conductors 11 and 13 are basically a multiple of $\lambda/8$, but may be slightly changed due to an interaction thereof and the respective resonance frequencies of the helical conductors 11 and 13 are determined by the respective lengths and the respective winding numbers thereof.

Accordingly, a large difference in the lengths and the winding numbers of the helical conductors 11 and 13 as shown in FIG. 2A, will result in a correspondingly large difference in the resonance frequencies thereof, and vice versa as shown in FIG. 2B.

Therefore, in case of manufacturing an antenna capable of operating in two different frequency bands, the length and the winding number of each of the helical conductors are designed to resonate at respective corresponding frequencies, while in case of one frequency band, the length and the winding number of each thereof are constructed to be substantially equal to each other.

Further, the length and the winding number of each of the helical conductors are adjusted depending on a dielectric constant of the support 15 used in such a way that each of the helical 11 and 13 resonates a different frequency band.

A voltage, applied through a matching circuit(not shown) of the antenna as described above to a coaxial feeder 20, is applied to the helical conductors connected thereto, thereby allowing the helical conductors to resonate at a different frequency.

Figure 6:
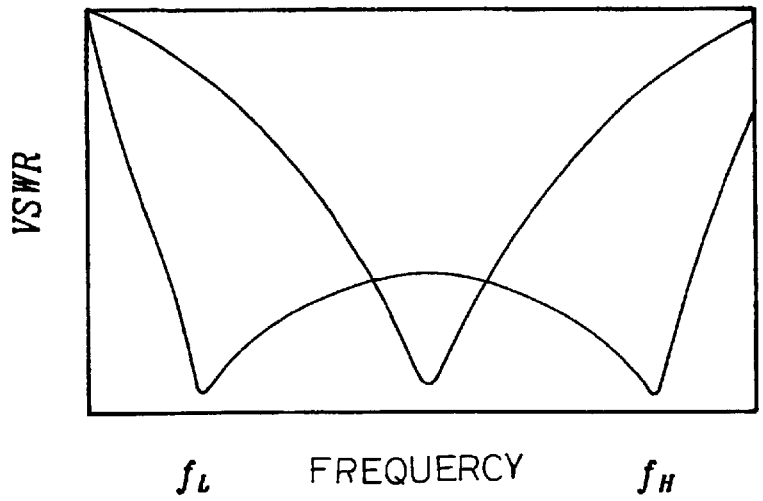
FIG. 6 demonstrates a graph for showing a characteristic of the inventive antenna for mobile telecommunication units.

As best shown in FIG. 6, the inventive antenna including the above helical conductors 11 and 13 can be operated in two different frequency bands, thereby extending a frequency bandwidth, as a result of a return loss value at the respective resonance frequencies, referred herein as, $f_H$ and $f_L$, becoming minimum. It is of course that the present invention may be obtained by using two coils wound in the same direction on a support made of insulating materials, by using two coils wound in the same direction in air, or by using a metallic pattern such as two coils on a dielectric body, ceramic body and the like.

Figure 3A:
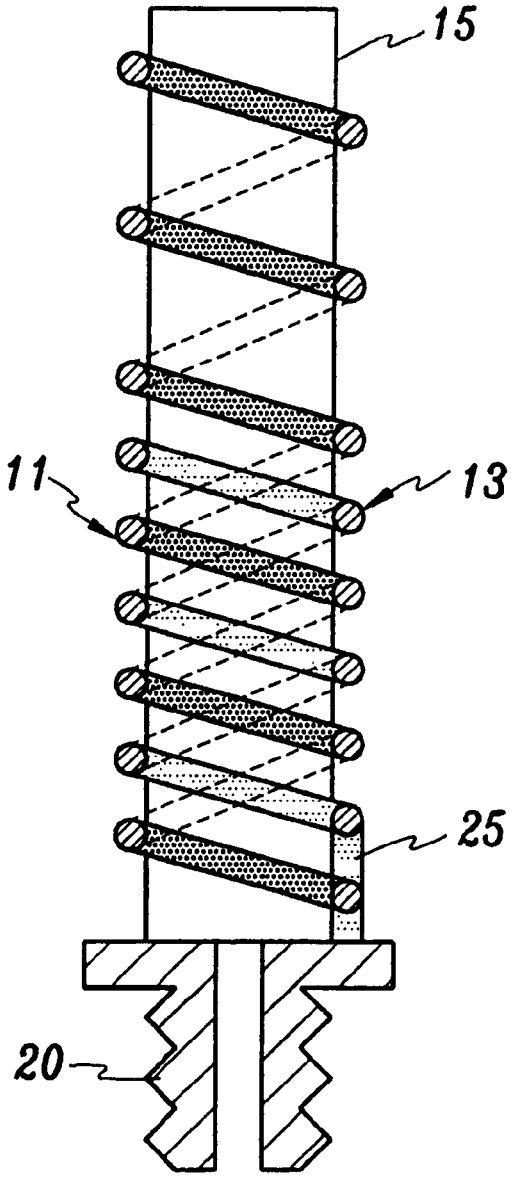
FIGS. 3A and 3B set forth cross sectional views of a dual-band antenna for mobile telecommunication units in accordance with a second embodiment of the present invention.
Figure 3B:
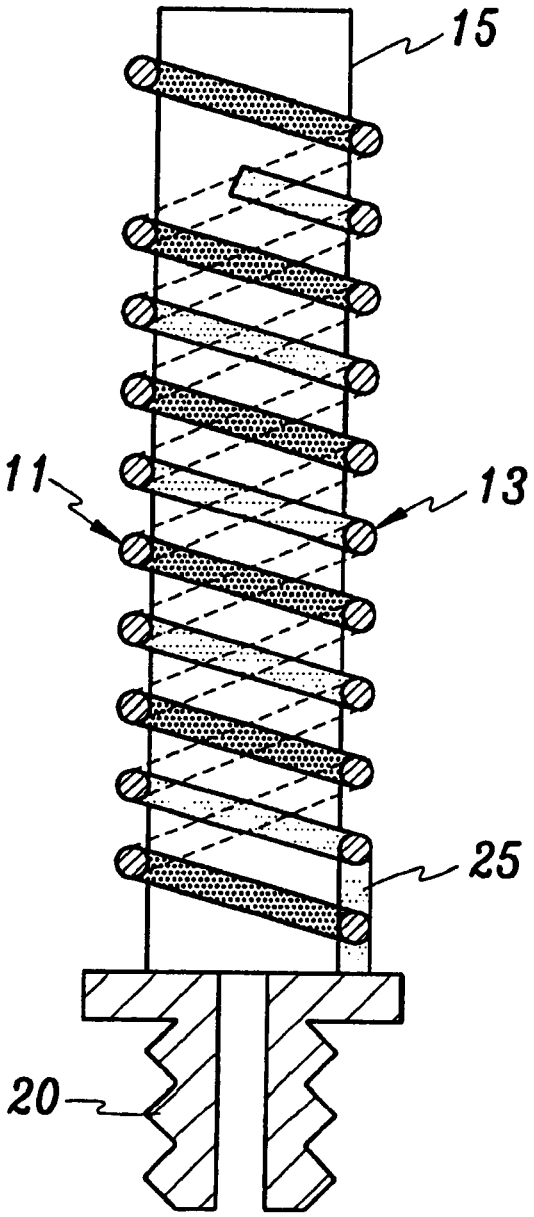

There is shown in FIGS. 3A and 3B a dual-band antenna in accordance with a second embodiment of the present invention. This embodiment is similar to the first embodiment as described above except that an identical feeder distribution center 25 of the coaxial feeder 20 is used to allow an end of each of the helical conductors 11 and 13 to be connected thereto so that a voltage can be applied to the helical conductors through the identical feeder distribution center 25.

In this embodiment, a current distribution between the helical conductors 11 and 13 has a small phase difference, thereby preventing a performance of the antenna from degrading.

Figure 4A:
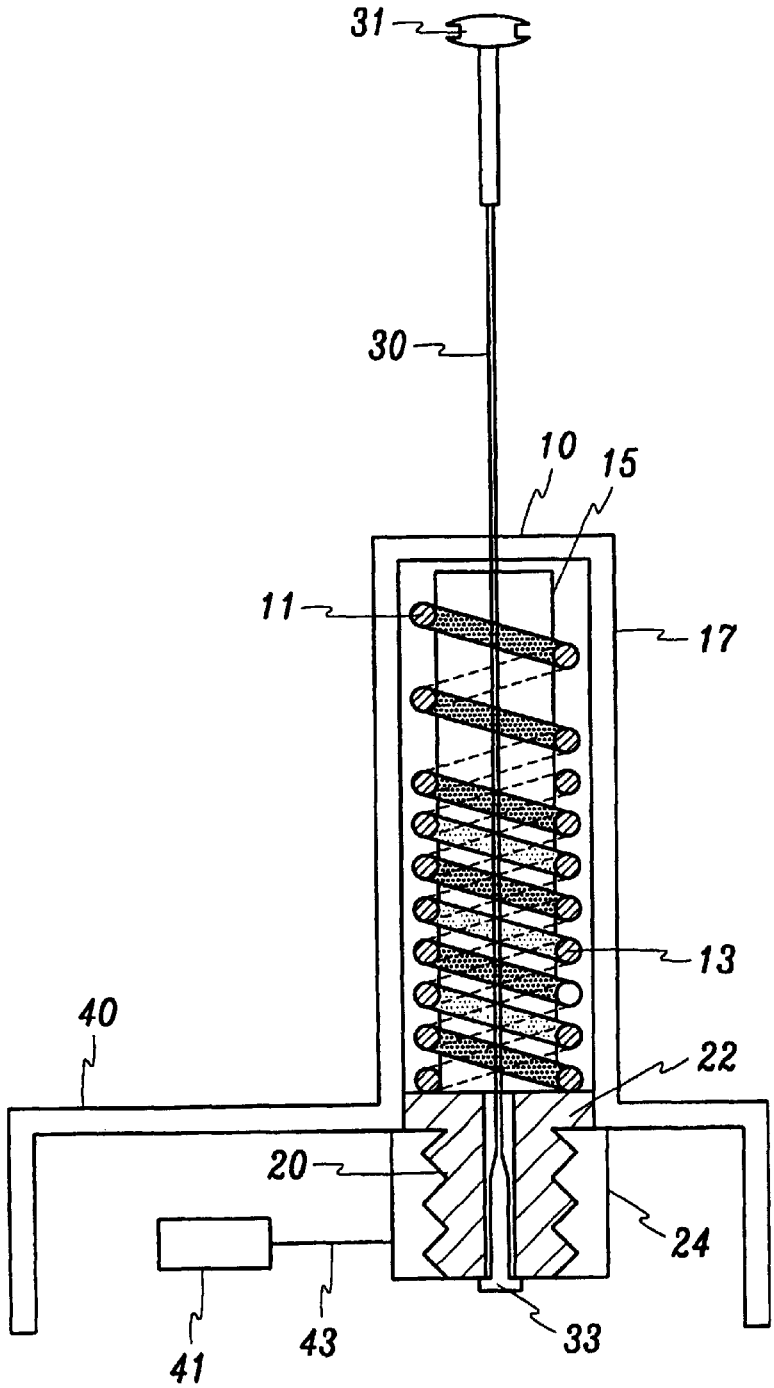
FIGS. 4A and 4B present cross sectional views of a dual-band antenna for mobile telecommunication units in accordance with a third embodiment of the present invention.
Figure 4B:
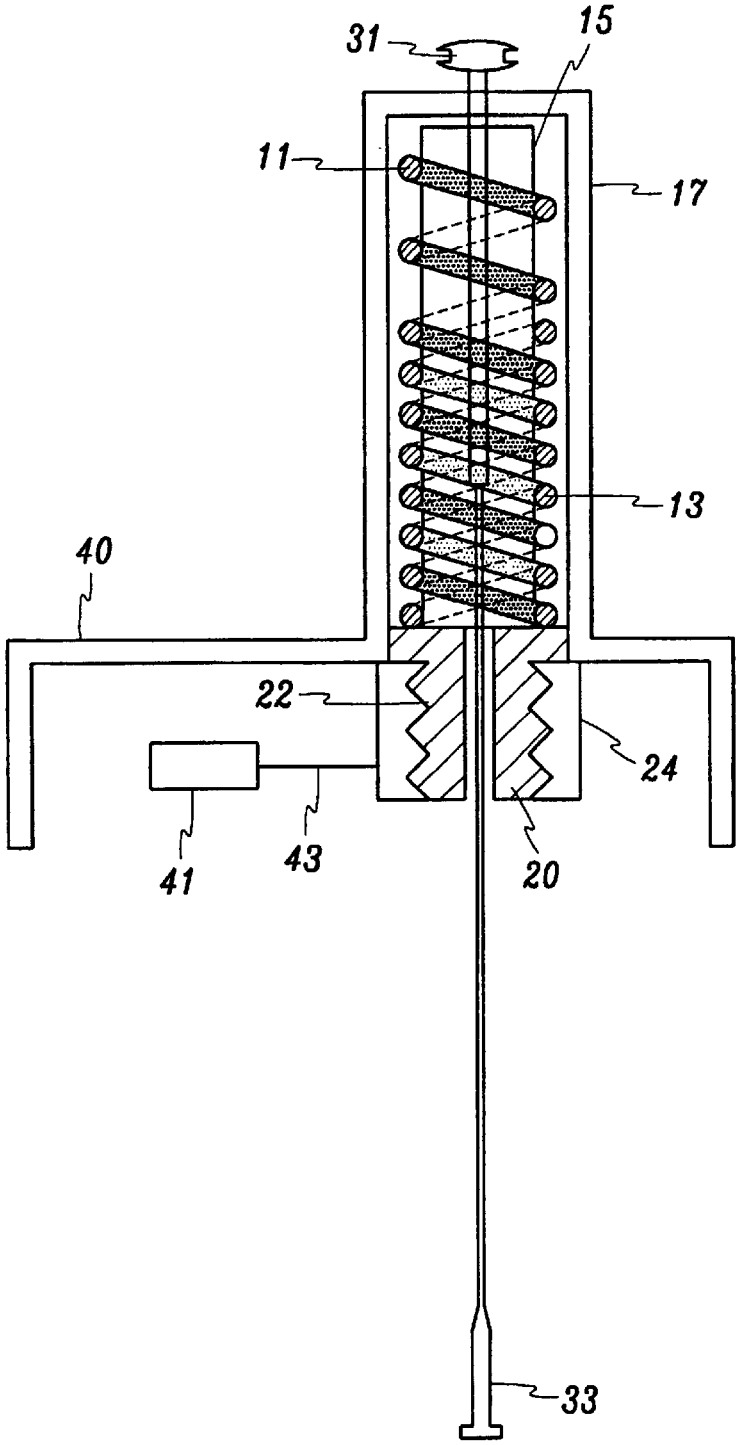

Referring to FIGS. 4A and 4B, there is shown a dual-band antenna in accordance with the third embodiment of the present invention. Parts similar to those previously described with reference to the first embodiment are denoted by the same reference numerals. As shown, a dual-band antenna includes a support 15 made of insulating materials and having a hollow portion therein, a coaxial feeder 20 mounted on an upper end of a unit 40, a helical antenna 10 fixed on the coaxial feeder 20 and a whip or monopole antenna 30 extractably and retractably disposed in the hollow portion of the helical antenna 10.

A metallic screw portion 22 having a female screw shape is fixed to an upper portion of the unit 40 and a conductive ring 24 is wound on the screw portion 22 and connected to a matching circuit 41 by way of a feeder connector 43.

The helical antenna 10 includes a first helical conductor 11 wound on the support 15 and having a first resonance frequency and a second helical conductor 13 wound on the support 15 and having a second resonance frequency, the second helical conductor being separated from the first helical conductor. A protective cap 17 is affixed to the unit 40 to thereby shield an exterior of the helical conductors 11 and 13.

Each lower end of the helical conductors 11 and 13 is fixed to an upper end of the screw portion 22 to thereby be fixedly connected to the respective different feeder distribution centers as described at the first embodiment or to the same feeder distribution center as described at the second embodiment.

The whip antenna 30 is a metallic monopole antenna, an upper end thereof being provided with a whip antenna cap 31 and a lower end thereof with a metallic feeding terminal 33, and is protected by a protective cover. Further, the whip antenna 30 is extractably and retractably mounted through the hollow portion of the support 15. Basically, the length of the whip antenna 30 basically is a multiple of $\lambda/8$, but may be changed depending on the design need.

When the whip antenna 30 is extended through the hollow portion of the helical antenna 10 to an outside of the unit 40 as shown in FIG. 4A, the feeding terminal 33 formed at the lower end of the whip antenna 30 is inserted into the screw portion 22 of the coaxial feeder 20 to thereby be in contact therewith. This, in turn, allows a voltage output from the matching circuit 41 to be applied through the feeder connector 43, the conductive ring 24 and the screw portion 22 to the feeding terminal 33, completing a power feeding of the whip antenna 30. At this time, the helical antenna 10 always remains under the power feeding condition regardless of an operation of the whip antenna 30 because the helical conductors 11 and 13 of the helical antenna 10 are fixed on the coaxial feeder 20, allowing the helical antenna 10 to operate at two frequency bands, thereby allowing a telecommunication service to use two different frequency bands.

On the contrary, when the whip antenna 30 is inserted into the hollow portion of the helical antenna 10 to be thereby received in an inside of the unit 40 as shown in FIG. 4B, the feeding terminal 33 formed at the lower end of the whip antenna 30 is separated from the screw portion 22 of the GO coaxial feeder 20 to be thereby electrically disconnected thereto, allowing the voltage output from the matching circuit 41 to be not applied to the feeding terminal 33. This results in only the helical antenna 10 operating. Further, a cap formed at top of the whip antenna 30 is hindered by the protective cap 17 of the helical antenna 10, thereby preventing the whip antenna 30 from being inserted into the inside of the unit 40.

Figure 5A:
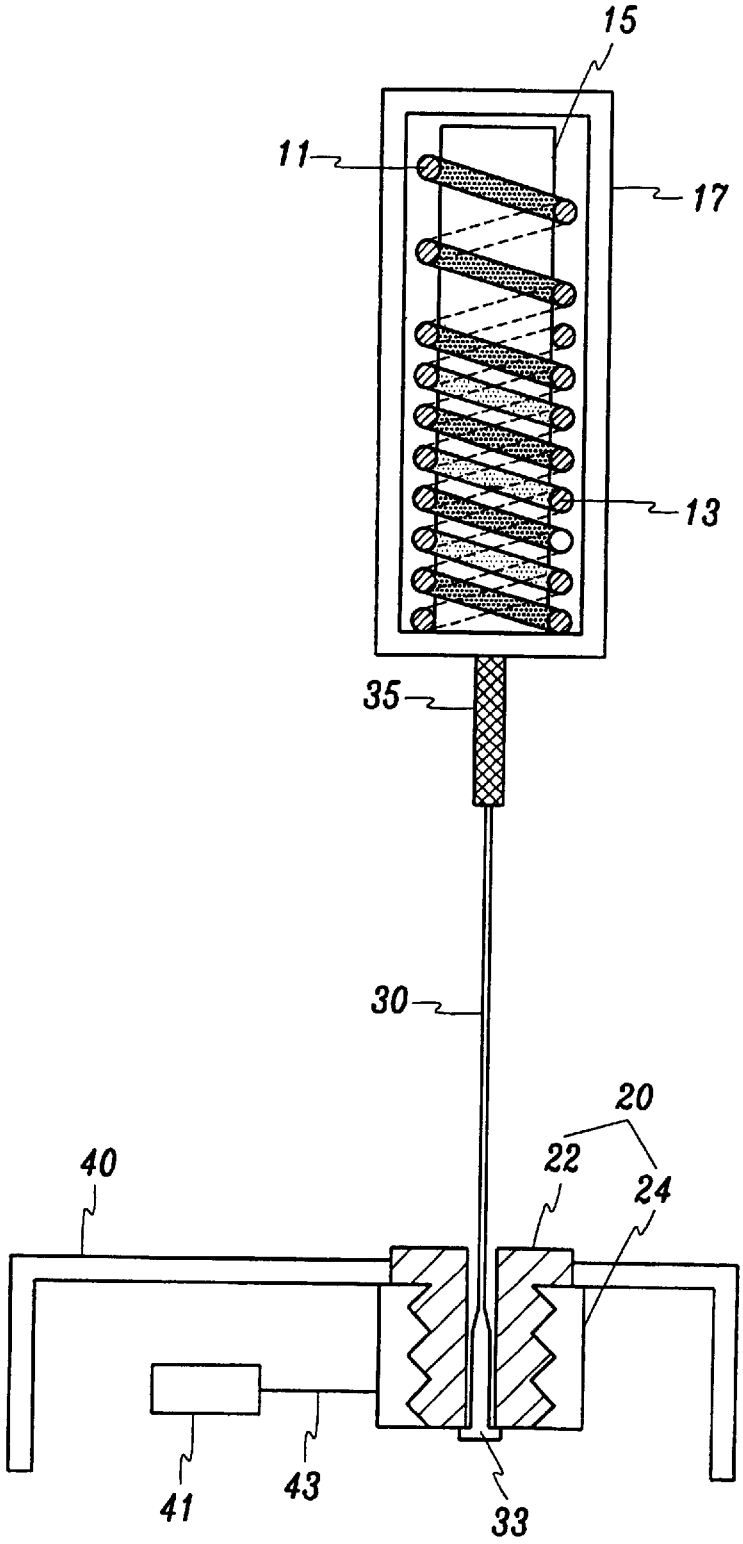
FIGS. 5A and 5B illustrate cross sectional views of a dual-band antenna for mobile telecommunication units in accordance with a fourth embodiment of the present invention.
Figure 5B:
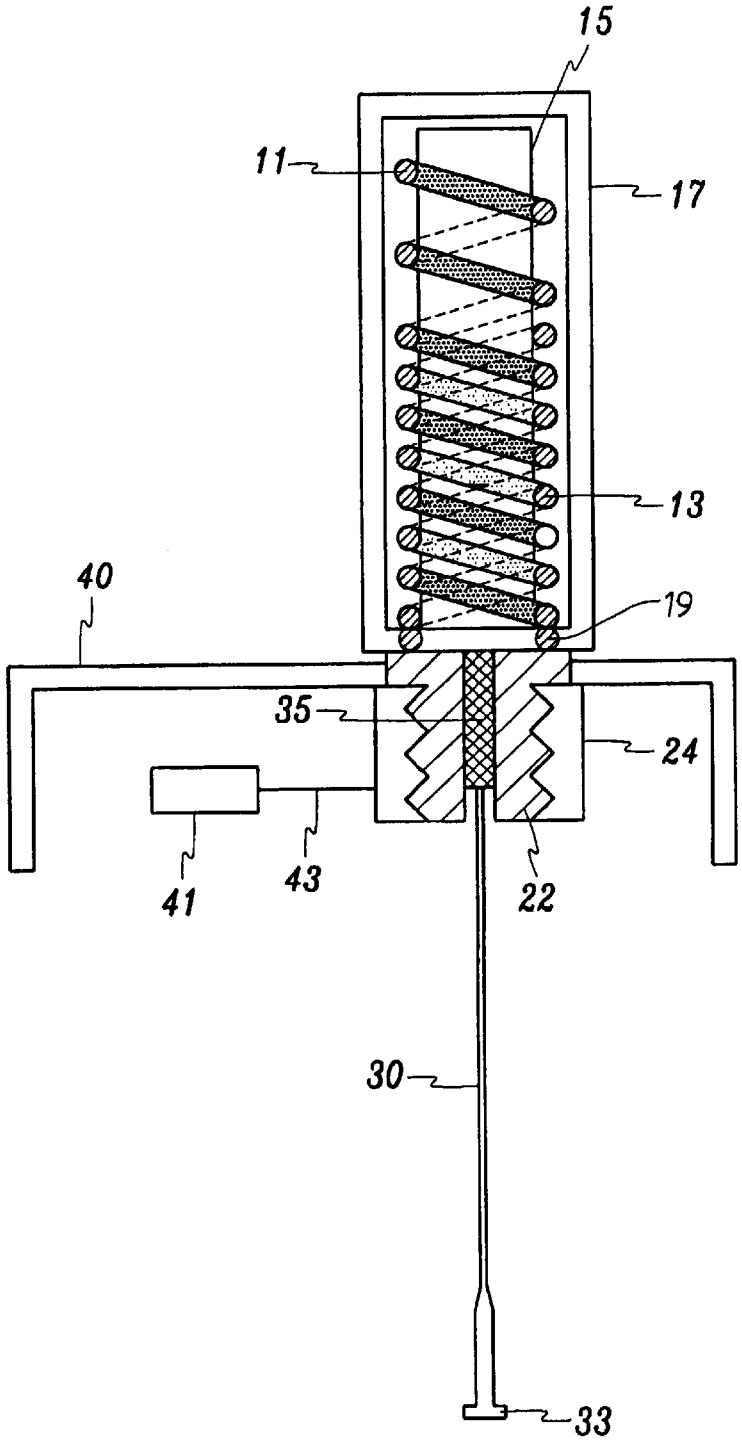

Referring to FIGS. 5A and 5B, there is shown a dual-band antenna in accordance with the fourth embodiment of the present invention. Parts similar to those previously described with reference to the first embodiment are denoted by the same reference numerals. As shown, a dual-band antenna includes a support 15 made of insulating materials, a coaxial feeder 20 mounted on an upper end of a unit 40, a whip or monopole antenna 30 extendible and receivable disposed in a screw portion 22 of the coaxial feeder 20 and a helical antenna 10 disposed to top of the whip antenna 30.

The structure of the coaxial feeder 20, the whip antenna 30 and the helical antenna 10 are similar to that of the third embodiment of the present invention and, thus, will not be further discussed herein for the purpose of the avoiding redundant description thereof.

An upper portion of the whip antenna 30 is provided with a conductive connector 35 in such a way that the helical antenna 10 is connected to the whip antenna 30. A connecting terminal 19 for a power feeding is formed on a lower portion of the protect cap 17 of the helical antenna 10 in such a way that the helical conductors 11 and 13 are fixed thereto. Even though as shown in FIG. 5, the support 15 of the helical antenna 10 may not have a hollow portion, but it may also have the hollow portion as described in the above third embodiment.

When the helical antenna 10 and the whip antenna 30 are extended through the screw portion 22 of the coaxial feeder 20 to an outside of the unit 40 as shown in FIG. 5A, the feeding terminal 33 formed at the lower end of the whip antenna 30 is inserted into the screw portion 22 of the coaxial feeder 20 to thereby be in contact therewith. Therefore, a voltage output from the matching circuit 41 is applied through the feeder connector 43, the conductive ring 24 and the screw portion 22 to the feeder terminal 33, thereby completing a power feeding of the whip antenna 30. Further, the voltage applied to the whip antenna 30 is applied through the connector 35 and the connecting terminal 19 to the helical antenna 10, thereby accomplishing the power feeding of the helical antenna 10, allowing the whip antenna 30 and the helical antenna 10 to be operated at the same time.

On the contrary, when the whip antenna 30 is inserted into the screw portion 22 of the coaxial feeder 20 to be thereby received in an inside of the unit 40 as shown in FIG. 5B, the feeding terminal 33 formed at the lower end of the whip antenna 30 is separated from the screw portion 22 of the coaxial feeder 20 to be thereby electrically disconnected thereto. As a result, the protective cap 17 of the helical antenna 10 formed at top of the whip antenna 30 is in contact with the coaxial feeder 20 formed in the unit 40, thereby allowing the voltage output from the matching circuit 41 to be applied through the feeding connector 43, the conductive ring 24, the screw portion 22 and the connecting terminal 19 formed at bottom of the protect cap 17 to the helical antenna 10 and through the conductive connector 35 to the whip antenna 30. As a result, the helical antenna 10 and the whip antenna 30 are operated together in such a way that the helical conductors 10 and 30 resonate a desired corresponding frequency, respectively, thereby transmitting and receiving each of the radio signals in a different frequency band.

It is preferable that the connecting terminal 19 formed at bottom of the protect cap 17 may be made of nonconductive materials to thereby allow the helical antenna 10 to be electrically insulated or may be made by a member having a capacitor components to thereby accomplish the power feeding of the helical antenna 10 through a coupling.

For example, in order to be used in both of the cellular system and the PCS as a mobile telecommunication commercialized, the helical conductors 11 and 13 are manufactured using the following table 1 such that the first helical conductor 11 resonates to 850 MHz of the frequency of the cellular system and the second helical conductor 13 resonates to 1.8 GHz of that of the PCS.

TABLE 1

| | frequency | radius | winding number | height |
|---|---|---|---|---|
| first helical conductor | 850 MHz | 2.5 mm | 10 | 11.6 mm |
| second helical conductor | 1.8 GHz | 2.5 mm | 7.7 | 9.0 mm |

In Table 1, the helical conductors 11 and 13 are made of copper wire having a diameter of 0.4 mm. The helical antenna manufactured using the values disclosed in Table 1 is mounted on a unit having a right-angled hexahedral shape of 120 mm(height)×50 mm(width)×20 mm (length). Further, the unit is made of aluminum materials and a power feeding is accomplished by using a coaxial line.

The radiation characteristics of the helical antenna as described above are shown in FIGS. 7A and 7B. It is preferable for the antenna to be omnidirectional since customer's position is generally not fixed in one direction with respect to a base station. It is, however, impossible to obtain an antenna having an isotropic radiation pattern over three dimensional space. Consequently, the radiation pattern of the antenna in the three dimensional space is designed to have a doughnut-shaped radiation characteristic.

Figure 7A:
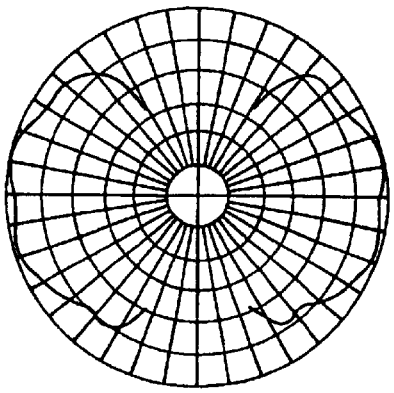
FIGS. 7A & 7B provides a radiation pattern of the inventive antenna for mobile telecommunication units.
Figure 7B:
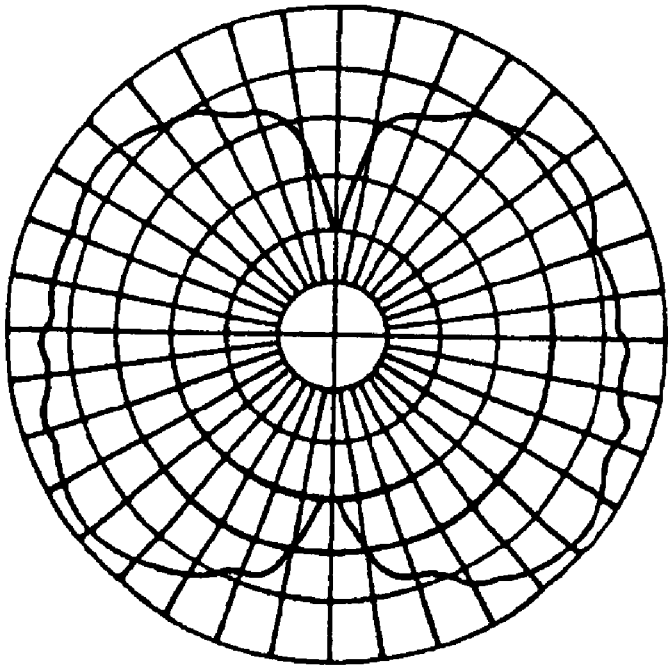

The radiation patterns obtained from a helical antenna which is manufactured using the values disclosed in Table 1, the values being obtained through a simulation performed by using IE3D manufactured by Zeland and HFSS by HP, are shown in FIGS. 7A and 7B.

The radiation characteristic of an inventive helical antenna is in the form of a butterfly at 850 MHz of frequency as shown in FIG. 7A, and, likewise, at 1.8 GHz of frequency as shown in FIG. 7B. Accordingly, by using two helical conductors having a different length, respectively, it is possible to provide an antenna capable of being operated in two frequency bands and having an optimum performance.

As described above, since the inventive dual-band antenna is small in size while preserving its performance, it can be used in accelerating the miniaturization of the mobile telecommunication units.

Further, by using the dual-band antenna of the present invention, the customer can make use of more than one mobile telecommunication services without changing the mobile phone unit.

While the invention has been shown and described with respect to the preferred embodiments, it will be understood by those skilled in the art that various changes and modifications may be made without departing from the spirit and scope of the invention as defined in the following claims.

What is claimed is:

1. A dual-band antenna for mobile telecommunication units comprising:

a support made of insulating materials and provided with a hollow portion at center thereof;

a first antenna including a first helical conductor wound on the support and having a first resonance frequency and a second helical conductor wound on the support and having a second resonance frequency, the second helical conductor being separated from the first helical conductor and the first and the second helical conductors being wound on the support in a same direction;

a second antenna extractably and retractably mounted in the hollow portion of the support and provided with a feeding terminal at a lower portion thereof; and a coaxial feeder for applying a voltage to an end of each of the helical conductors connected thereto and for applying the voltage to the feeding terminal when the second antenna is extracted.

2. A dual-band antenna for mobile telecommunication units comprising:

a support made of insulating materials;

a first antenna including a first helical conductor wound on the support and having a first resonance frequency and a second helical conductor wound on the support and having a second resonance frequency, the second helical conductor being separated from the first helical conductor and the first and the second helical conductors being wound on the support in the same direction to each other;

a second antenna extractably and retractably mounted in the unit and provided with a conductive conductor at an upper portion thereof and a feeding terminal at a lower portion thereof, wherein the support and the first antenna are mounted on top of the conductive conductor; and a coaxial feeder mounted on an upper part of the unit for applying a voltage to the first and the second antennas.

3. The dual-band antenna of claim 2, wherein the voltage is applied to the first and the second antennas through the conductive conductor and the feeding terminal when the second antenna is retracted and extracted, resepctively.

* * * * *